US005155497A

United States Patent [19]

Martin et al.

[11] Patent Number: 5,155,497

[45] Date of Patent: Oct. 13, 1992

[54] SERVICE STATION FOR INK-JET PRINTER

[75] Inventors: Paul W. Martin, Battle Ground; J. Paul Harmon, Vancouver; Kris M. English, Vancouver; Wen-Li Su, Vancouver, all of Wash.

[73] Assignee: Hewlett-Packard Company, Palo Alto, Calif.

[21] Appl. No.: 737,628

[22] Filed: Jul. 30, 1991

[51] Int. Cl.[5] ..... B41J 2/165

[52] U.S. Cl. ..... 346/1.1; 346/140 R

[58] Field of Search ..... 346/140 R, 75, 1.1, 346/139 R

[56] References Cited

U.S. PATENT DOCUMENTS

| | | | |
|---|---|---|---|
| 4,853,717 | 8/1989 | Harmon et al. | 346/140 R |
| 4,872,027 | 10/1989 | Buskirk et al. | 346/140 R |
| 5,018,884 | 5/1991 | Hirano et al. | 400/126 |
| 5,049,904 | 9/1991 | Nakamura et al. | 346/140 R |
| 5,051,761 | 9/1991 | Fisher et al. | 346/140 R |
| 5,103,244 | 4/1992 | Gast | 346/1.1 |

FOREIGN PATENT DOCUMENTS

| | | | |
|---|---|---|---|
| 0048403 | 3/1984 | Japan | 346/75 |
| 0048407 | 7/1984 | Japan | 346/140 R |
| 62-251145 | 10/1987 | Japan . | |
| 0048712 | 12/1987 | Japan | 346/140 R |

OTHER PUBLICATIONS

*Integrating the Printhead into the HP DeskJet Printer,* Hewlett Packard Journal, Oct. 1988, pp. 62–66.

*Development of a High-Resolution Thermal Inkjet Printhead,* Hewlett-Packard Journal, Oct. 1988, pp. 55–61.

*Primary Examiner*—Joseph W. Hartary

[57] ABSTRACT

The service station provides components for wiping and capping the orifice plate of an ink-jet pen that is installed in a printer that can carry more than one pen-type. Certain service station components are dedicated for use with only one type of pen and other components are dedicated for use with another type of pen, thereby avoiding ink contamination that may occur, where, for example, a single wiper is used to wipe pens of both type.

17 Claims, 10 Drawing Sheets

SERVICE STATION FOR INK-JET PRINTER

BACKGROUND OF THE INVENTION

This invention is directed to mechanisms for maintaining the operability of pens that are used for ink-jet printing.

Pens used with advanced ink-jet printers include print heads that have orifice plates formed with very small nozzles through which are fired ink drops. The drops are sized and fired for high-resolution printing. The ink used with such pens dries quickly, thereby enabling the printer to use plain paper.

The combination of small nozzles with quick-drying ink makes the pen print head susceptible to failure in the event that some or all of the nozzles become clogged with dried ink or minute dust particles, such as paper fibers.

An ink-jet printer manufactured by Hewlett-Packard Company and designated the "DeskJet" printer includes a service station assembly that features a mechanism for capping the print head nozzles when the pen is not printing. The cap mechanism encloses the exposed outer surface of the orifice plate to prevent drying of the ink near the nozzles. The cap also protects the nozzles from contact with dust. The service station assembly includes a wiper mechanism for wiping away particles that may accumulate on the orifice plate during printing. The service station assembly also includes a receptacle into which the pen periodically fires to purge dried or plugged nozzles.

SUMMARY OF THE INVENTION

Presently available are ink-jet printer pens that contain only black ink (hereafter referred to as black pens). Also available are pens that carry inks of subtractive primary colors (cyan, magenta, and yellow), which may be used for printing a variety of colors, including black (these pens hereafter referred to as color pens).

It has been found to be advantageous to configure an ink-jet printer for interchangeably using a black pen and a color pen. It is important, however, that, in the course of using two different pens, ink from one pen does not contaminate the other pen.

The present invention is directed to a service station for use with a two-pen type printer as just described. The service station includes certain components that are dedicated for use with only the black pen, and certain components dedicated for use with only the color pen. The service station thereby avoids the ink contamination that may occur where, for example, a single wiper is used to wipe both a color pen and a black pen.

The service station is constructed with movable components that permit separate wiping and capping of black and color pens and require only minimal space in the printer body.

The printer detects which pen-type is installed, and the orientation of service station components is adjusted accordingly for servicing (wiping and capping) the orifice plate of the particular pen that is installed in the printer.

DETAILED DESCRIPTION OF A PREFERRED EMBODIMENT

Figure 6:
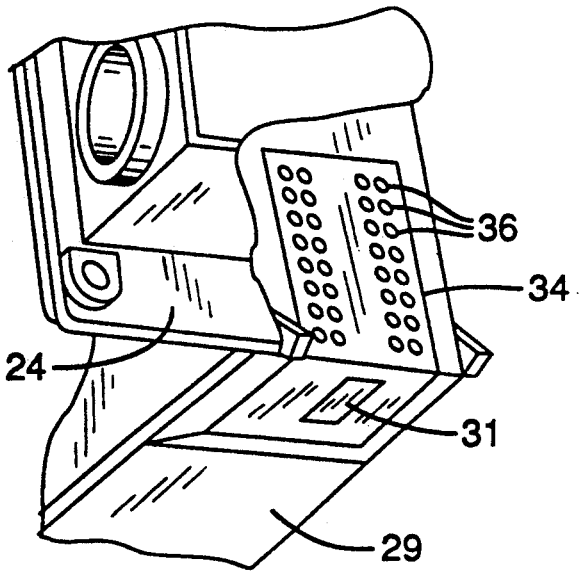
FIG. 6 is a perspective view showing the front and underside of a conventional ink-jet pen and a portion of the printer carriage.

As shown in FIGS. 1–4, the service station 20 of the present invention is mounted to the chassis 22 of an ink-jet printer. The printer also includes a carriage 24 that holds an ink-jet pen 26. The pen 26 may be, for example, a black pen, or, as shown in FIG. 6, a color pen 29. The carriage 24 is reciprocated by known means across the width of a sheet of paper that is advanced through the printer. The reciprocal motion of the carriage 24 defines a linear path of the carriage 24 as shown by arrow 28.

Referring to FIG. 6, a portion of a color pen 29 that faces the paper carries a generally rectangular orifice plate 31. The orifice plate 31 includes a plurality of orifices (not shown) shaped as nozzles through which ink drops are projected to form characters or other information on the paper. The nozzles are very small so that the drops can be delivered at a very high resolution. The ink that is projected from the orifice plate nozzles is formulated to dry quickly so that the pen may be used with plain paper.

Figure 1:
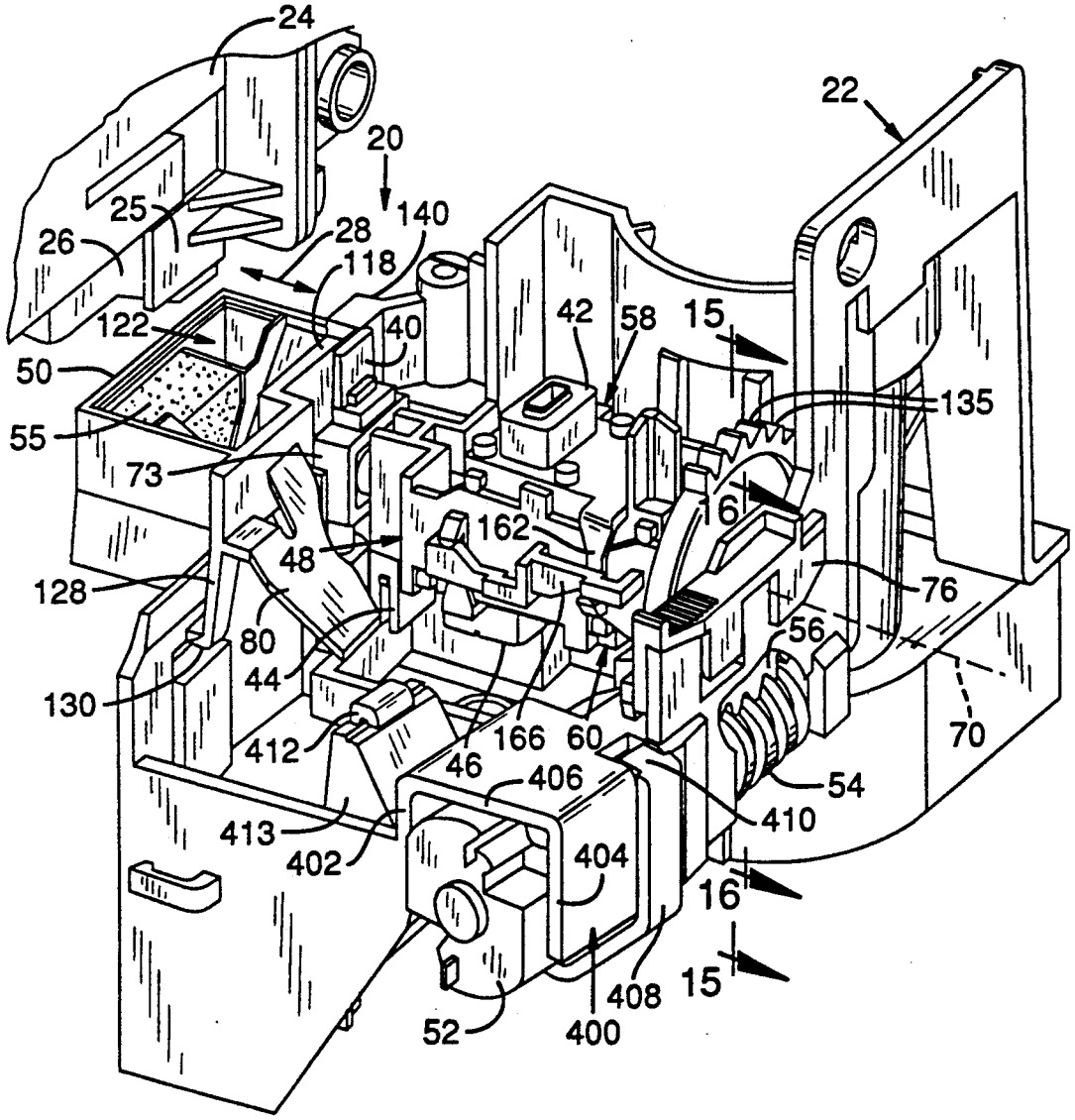
FIG. 1 is a perspective view of an assembled service station constructed in accordance with the present invention.
Figure 4:
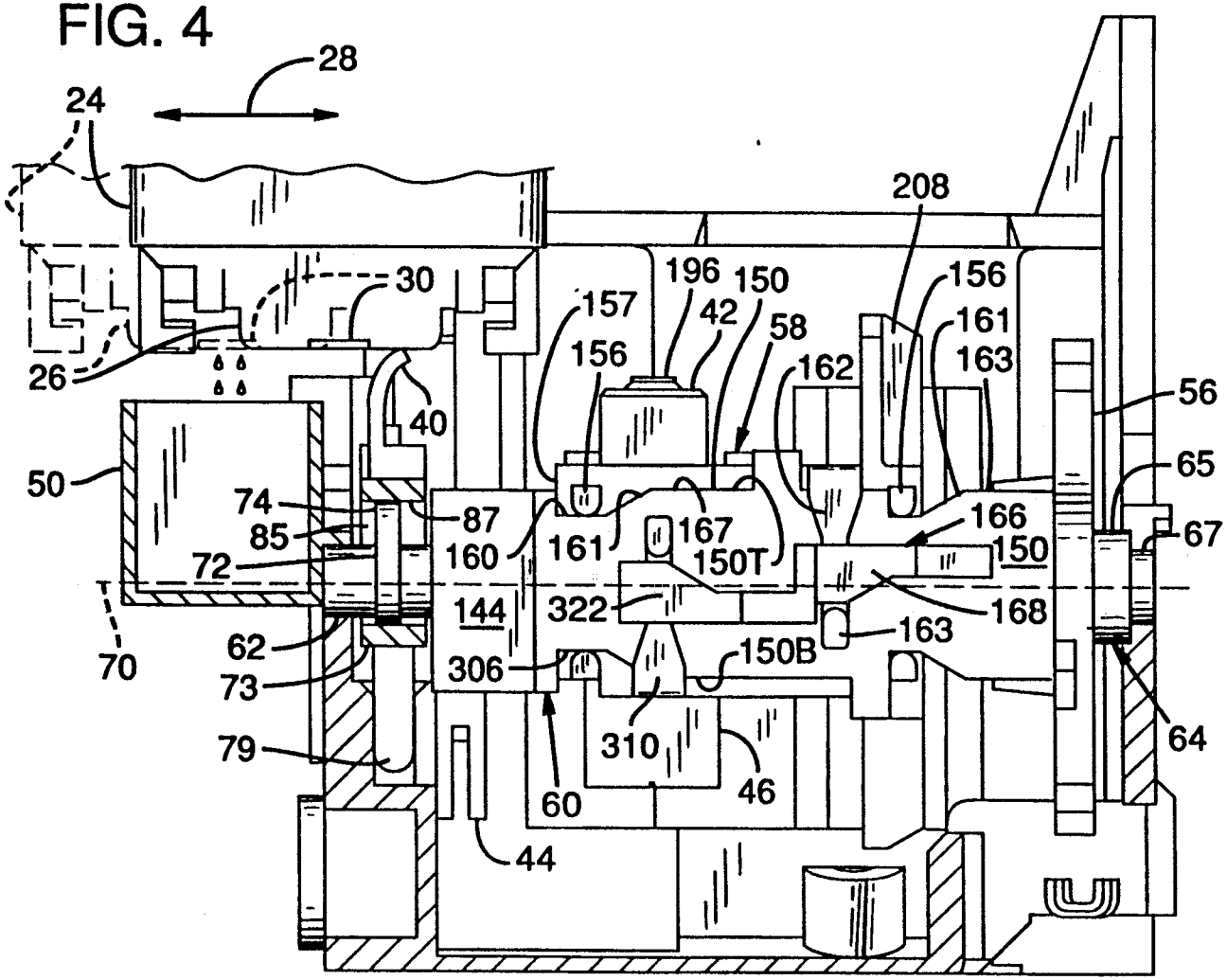
FIG. 4 is a side elevation view of the service station showing a black pen being wiped as the pen is moved toward a parked position.
Figure 5:
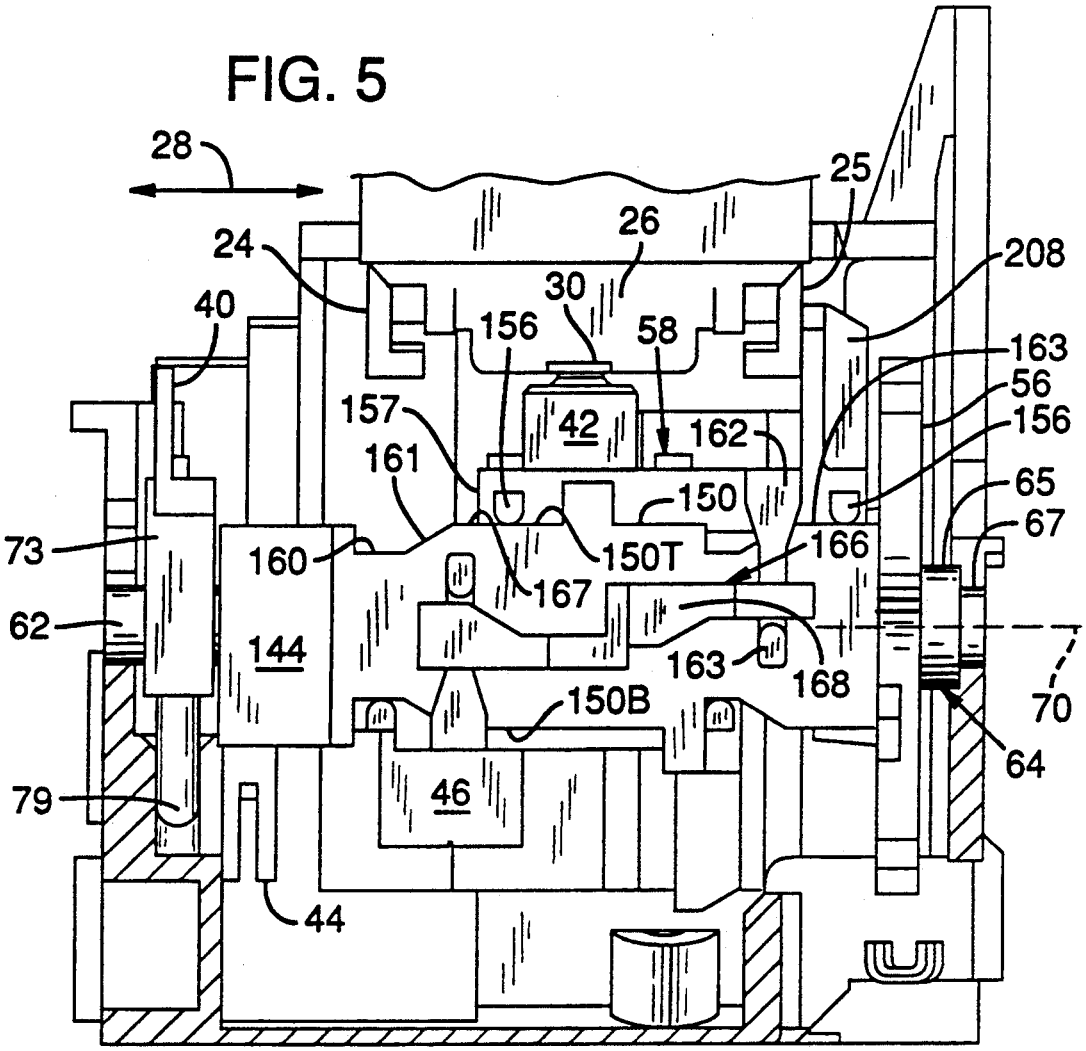
FIG. 5 is a side elevation view of the service station showing a black pen capped when the pen is in the parked position.

It is contemplated in the present invention that the carriage 24 may be adapted to carry either the black pen 26 depicted in FIGS. 1, 4 and 5, or a color pen 29 (FIGS. 6 and 7), which may or may not be the same size as the black pen 26. Irrespective or whether a black or color pen is carried in the carriage 24, the orifice plate 30 of the black pen and the orifice plate 31 of the color pen 29 will be held by the carriage 24 in substantially the identical position relative to the path 28 of the carriage (hence, relative to the paper moving past the orifice plate).

As is known in the art, each pen nozzle has associated with it a thin-film resistor that is selectably driven (heated) with sufficient current for vaporizing ink in the vicinity of the nozzle, thereby forcing through the nozzle a drop of ink. Drive lines to each nozzle resistor are carried upon a circuit 34 (FIG. 6) that is mounted to the exterior of the pen body. Circuit contact pads 36 (shown enlarged for illustration) at the ends of the resistor drive lines engage similar pads carried on a matching circuit that is attached to the carriage 24. The signals for firing the nozzle resistors are generated by a microprocessor and associated drivers that apply the firing signals to the resistor drive lines.

Preferably, the printer is equipped with a monitoring circuit for detecting failure of any nozzle resistor. Such a circuit may include a comparator that monitors the voltage drop of other resistors that are connected in series with the nozzle resistors. The comparator output (e.g., a digital LOW where sufficient current is flowing through a nozzle resistor) is monitored by the microprocessor. As a result, failed contacts can be detected and reported before a printing operation is begun.

In addition to the resistor drive lines on the flexible circuit 34, there are also provided two "sense" lines that are configured for providing identification information for the particular pen to which the circuit is attached. The two sense lines are wired together and are connected to the microprocessor by a single identification line. The sense lines are fabricated so that either line may or may not be connected to a nozzle resistor drive line. If one or both sense lines are connected to a nozzle resistor drive line, a voltage drop on the identification line will be detected by the microprocessor via the monitoring circuit whenever the connected resistor line(s) is activated. If a sense line is fabricated so that it is not connected to a resistor drive line, no voltage drop will be detected by the microprocessor as that drive line is activated.

During the fabrication of the printer circuit 34, the sense lines are connected to the resistor drive lines, or left open, depending upon which pen-type (black or color) will carry the particular circuit. The open or closed sense lines, therefore, provide each pen with an identification code. As a result, by selectively firing one or both of the resistor drive lines that would be connected to the sense lines, the microprocessor is able to detect the identification code associated with the pen. In short, the microprocessor is able to determine whether the carriage holds a black pen or a color pen.

Between printing operations, the carriage 24 is moved along path 28 into a parked position on one side of the printer. The service station 20 of the present invention includes mechanisms for wiping the orifice plate of the pen as the carriage 24 is moved into and out of the parked position. Mechanisms are also included for capping the orifice plate whenever the pen is in the parked position. The service station 20 includes a wiper 40 and a cap 42 for wiping and capping a black pen 26, and an additional wiper 44 and cap 46 for wiping and capping a color pen 29.

The wipers and caps are mounted to a worm-driven carrier 48 that is rotated for interchanging the position of the black pen wiper 40 and cap 42 with the position of the color pen wiper 44 and cap 46, depending upon which pen type is held in the carriage 24.

To facilitate the determination of which pen type (black or color) is currently held in the carriage 24, a receptacle 50 is provided. The receptacle 50 has an open top. The pen 26 is moved over the receptacle 50, and the resistor drive lines to which the above-mentioned sense lines would be connected are fired by the microprocessor (the receptacle 50 receiving the fired ink, see FIG. 4) for detecting, as mentioned above, whether a black or color pen is carried in the carriage. If, for example, a color pen 29 is in the carriage 24, a miniature DC motor 52, which is connected to the rotatable carrier 48 via meshed worm "worm" 54 and spur gear 56, is driven by the microprocessor for a time period sufficient for rotating the carrier 48 into position for placing the color pen wiper 44 and color pen cap 46 into a service position for wiping and capping the orifice plate 31 of the color pen 29 as the carriage moves the pen into the parked position (dashed lines, FIG. 7).

Figure 7:
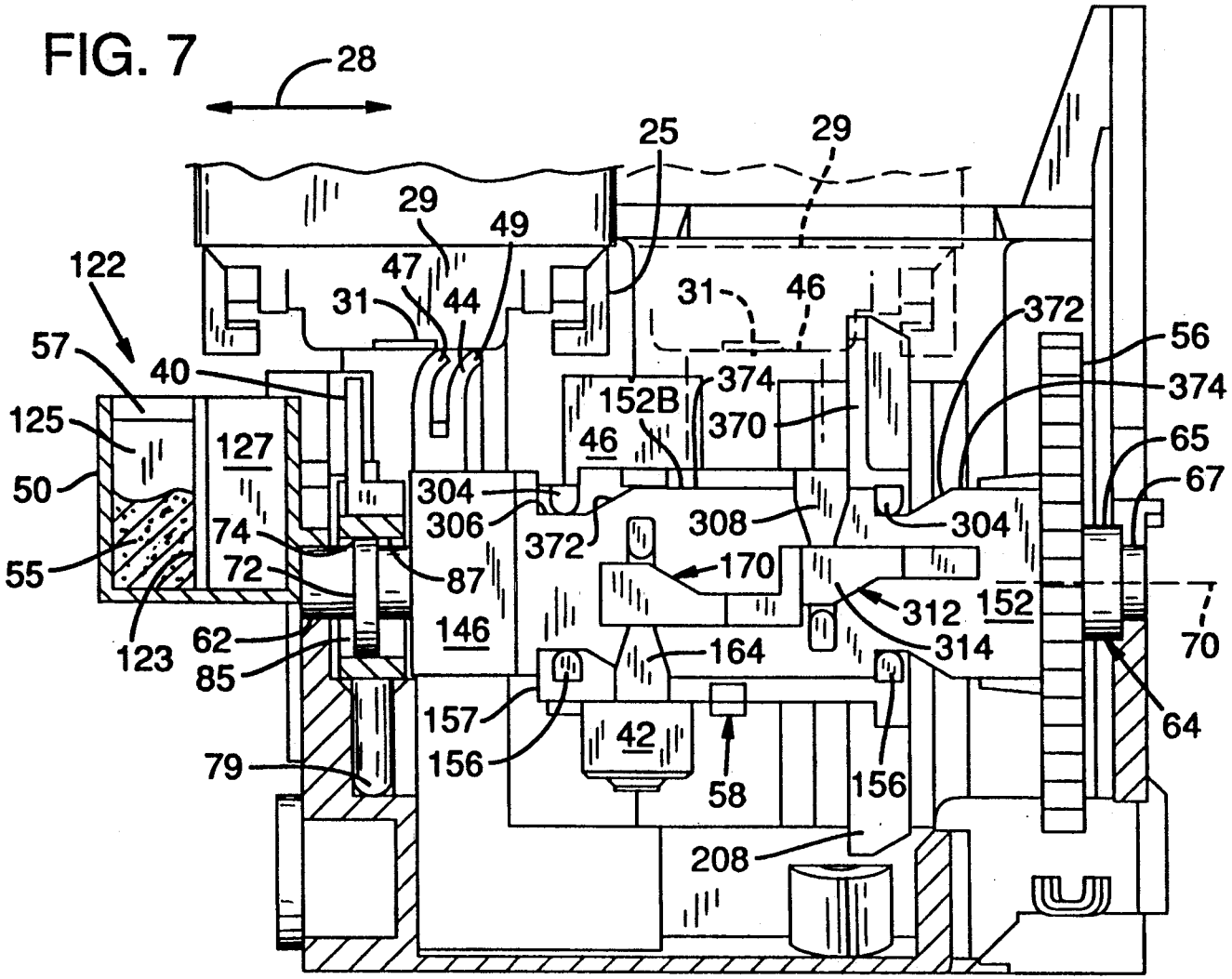
FIG. 7 is a side elevation view of the service station showing a color pen being wiped as the pen is moved toward a parked position.

The rotatable carrier 48 is mounted to the chassis 22 of the ink-jet printer at a location that is adjacent to the path 28 traveled by the carriage 24. One sled 58 (hereafter referred to as the black sled) is slidably mounted to one side of the carrier 48. The black sled 58 has mounted to it the black cap 42. The opposing side of the carrier 48 has another sled 60 (hereafter referred to as the color sled) slidably mounted to it. The color sled 60 carries the color cap 46. The carrier 48 rotates to place either the black sled 58 into the service position (FIG. 4) or the color sled 60 into the service position (FIG. 7). The term "service position" means the position whereby the wiper and cap associated with a particular sled are oriented to contact (wipe and cap) a pen that is moved into the parked position. The parked position of the black pen is shown in FIG. 5.

As described more fully below, the black sled 58 and color sled 60 are movable relative to the carrier 48. Whichever sled is placed by the carrier 48 in the service position is pushed along the carrier by the carriage 24 as the pen moves to the parked position. Specifically, the sled is pushed into a capping position, such as shown in FIG. 5, wherein the cap 42 mounted on the pushed sled is moved against the orifice plate 30 of the pen 26 for capping the nozzles of that plate. It is noteworthy that the black sled 58 is shown in FIG. 1 in the capping position, although, for clarity, the carriage 24 that pushes and holds the sled in the capping position is shown away from the sled 58.

Figure 2:
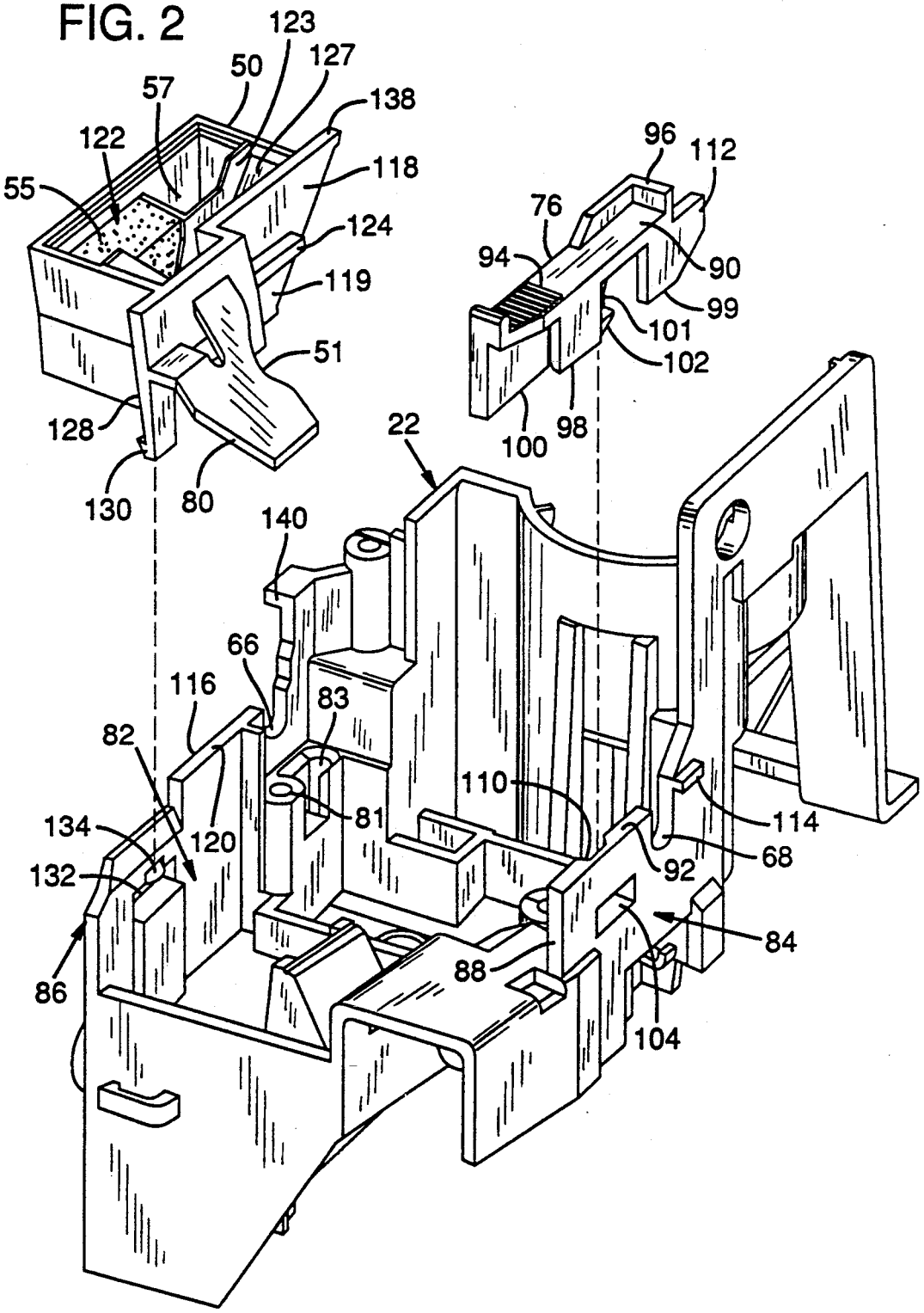
FIG. 2 is a perspective view showing the part of the printer chassis that forms the base of the service station.
Figure 3:
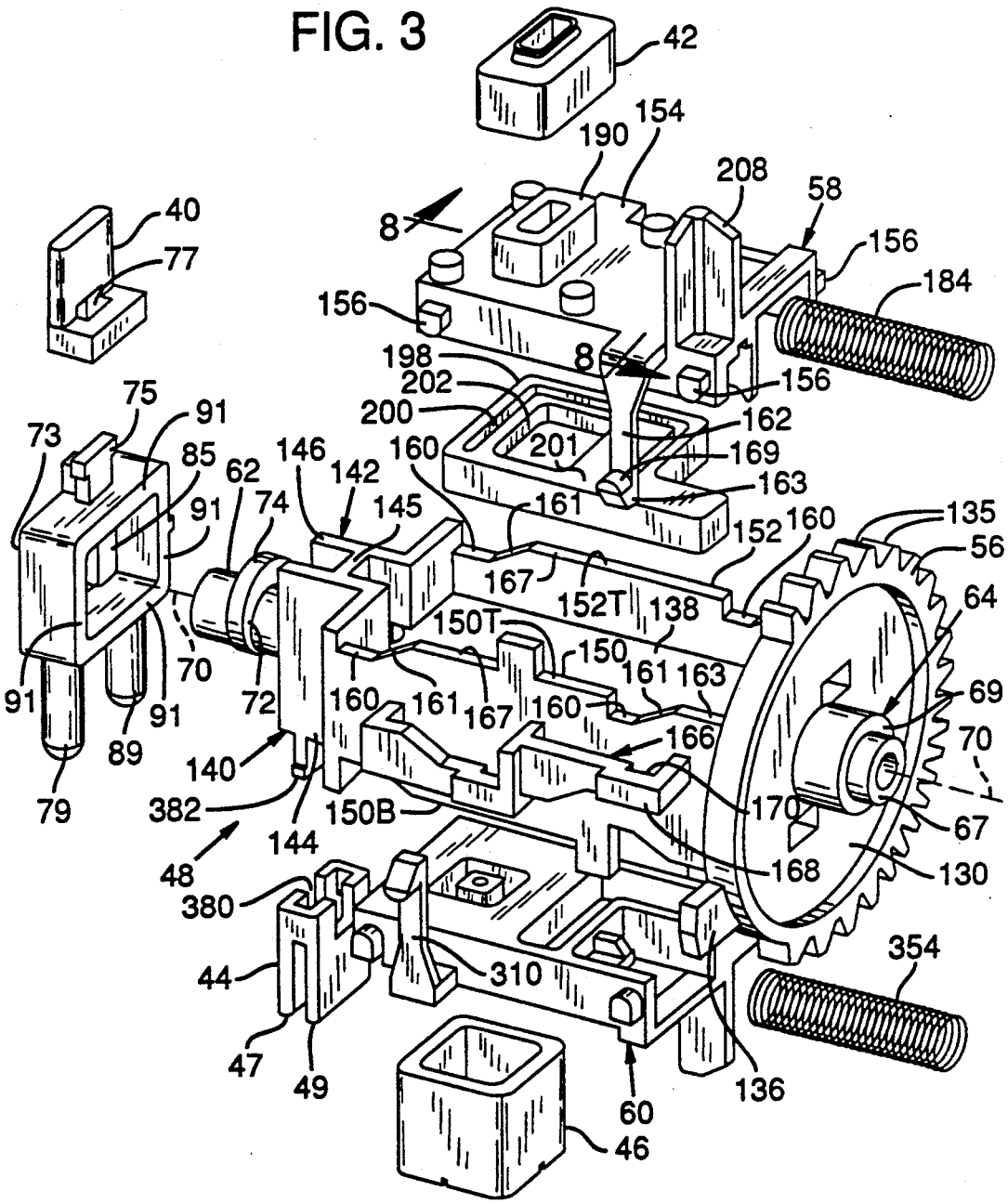
FIG. 3 is an exploded perspective view of the sleds and sled carrier, the primary moving components of the service station.

As best shown in FIGS. 2 and 3, one end of the carrier 48 has formed thereon the spur gear 56 that meshes with the worm 54 that is driven by the motor 52. The carrier 48 also has a spindle 62, 64 protruding from each end thereof. Each spindle rests in a correspondingly shaped notch 66, 68 in the chassis 22. The carrier 48 is rotatable about an axis 70 that defines the central axis of the spindles 62, 64 and that is parallel to the path 28 of the carriage 24.

The inner spindle 62 rests in the inner notch 66 and has mounted to it a cam 72 that engages a movable follower 73 to which the black-pen wiper 40 is fastened. As described more fully below, the follower 73 with attached black-pen wiper 40 is driven by the cam 72 into and out of a zone for wiping the orifice plate of a passing pen. For the purpose of this description, the above-mentioned wiping zone is a zone in the vicinity of the service station 20 and aligned with the movement of the pen orifice plate so that a flexible wiper (such as the black-pen wiper 40, FIG. 4) that projects into that zone will wipe the surface of the orifice plate (such as plate 30, FIG. 4) whenever the carriage 24 moves a pen into and out of the parked position.

The color-pen wiper 44 is mounted to the carrier 48 adjacent to the color sled 60 and rotates with the carrier into the just-mentioned wiping zone whenever the color sled is rotated into the service position (FIG. 7).

The carrier outer spindle 64 is held in place within outer notch 68 (FIG. 2) by a manually movable latch 76. The inner spindle 62 is secured against movement out of its notch 66 by the receptacle 50 that is mounted to slide on the chassis 22 over the inner spindle 62. The receptacle 50 also includes a cleaner bracket 80 for scraping clean the tips of the color-pen wiper 44 whenever the carrier 48 is driven to move the color sled 60 into and out of the service position.

Turning now to the particulars of a preferred embodiment of a service station 20 formed in accordance with the present invention, and with reference first to FIG. 2, the chassis 22 of the ink-jet printer provide a base for the station 20 and includes on one side a well 82 defined in part by an outer sidewall 84 and an inner sidewall 86. The outer sidewall 84 has formed in it the outer notch 68 into which fits the outer spindle 64 of the carrier 48. The spindle 64 includes a reduced-diameter outer end 67 (FIG. 3) that fits within the notch 68 and defines a shoulder 69 in the spindle that abuts the inner surface of the sidewall portion that is adjacent to the notch 68.

Figure 16:
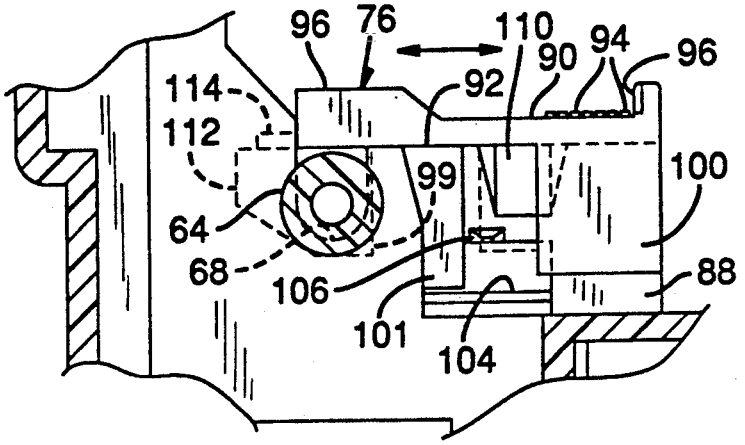
FIG. 16 is a view taken along line 16—16 of FIG. 1 depicting a latch used for securing the sled carrier to the service station base.

Next to the outer notch 68, the outer wall is formed into a bracket 88 to which is slidably mounted the latch 76. The latch 76 is manually movable to cover the notch and hold the outer spindle 64 therein. More particularly, and with reference to FIGS. 2 and 16, the latch 76 includes top plate 90, the underside of which rests upon the upper edge 92 of the bracket 88. The latch top plate 90 includes a ribbed portion 94 and an upwardly protruding lip 96 for facilitating manual movement of the latch 76 along the bracket edge 92.

The latch bracket 88 is straddled by a pair of outer legs 98, 99 that extend downwardly from one side of the top plate 90 and by a pair of inner legs 100, 101 that extend downwardly from the other side of the top plate 90. The forwardmost (i.e., to the left in FIG. 16) inner leg 101 of the latch 76 terminates in a hook 102 that extends through an oblong-shaped opening 104 formed through the latch bracket 88 beneath the upper edge 92 thereof. The hooked leg 101, therefore, retains the latch 76 on the latch bracket 88 and limits movement of the latch to sliding motion toward and away from the notch 68.

A small protuberance 106 is formed to protrude from the inner surface of the latch bracket 88 just above the center of the oblong opening 104. The protuberance 106 serves as a detent mechanism that is adjacent to the rearward side of the hooked leg 101 of the latch 76 when the latch is closed (i.e., securing the spindle 64 within the notch 68), thereby preventing the latch from moving out of the closed position in the absence of a manual force applied to the latch 76 for causing the hooked leg 101 to slide back over the protuberance 106. Whenever the latch 76 is moved out of the closed position, the spindle 64 may be raised out of the notch 68 for removing the carrier 48 from the chassis 22.

In the preferred embodiment, a guide groove 110 (FIG. 2) is provided for facilitating attachment of the latch 76 to the bracket 88. The groove 110 is formed in the inner surface of the latch bracket 88 to extend between the top edge 92 of the bracket to a location near the opening 104. The groove 110 generally decreases in depth in the direction toward the opening. The latch 76 is attached by fitting the hooked end of the leg 101 into the groove 110 and pressing the latch 76 downwardly so that the hook 102 slides within the groove 110 until it snaps into the oblong opening 104.

The forwardmost outer leg 99 of the latch 76 is shaped to extend across the outer surface of the sidewall 84 to completely cover the outer notch 68. The forward outer leg 99 also includes a nose portion 112. Whenever the latch 76 is moved into the closed position, the nose portion 112 slides under a lip 114 that protrudes from the outer surface of the sidewall 84, thereby securing the latch to prevent the latch 76 and spindle 64 from shifting upwardly within notch 68.

The receptacle 50 (see FIGS. 2 and 13) is shaped to secure the inner spindle 62 of the carrier 48 within inner notch 66. More particularly, the inner sidewall 86 of the printer chassis 22 defines a substantially flat receptacle bracket 116 near the inner notch 66. The receptacle 50 is slidably mounted to the bracket 116 and includes a support wall 118 that is carried on the upper edge 120 of the bracket 116.

The well 122 of the receptacle 50 is formed to extend inwardly (i.e., toward the upper left in FIG. 2) from the inner surface of the support wall 118. The forward (i.e., to the upper right in FIG. 2) portion of the support wall 118 is formed with a guide rail 124 protruding outwardly therefrom. The underside of the guide rail 124 rests upon the flat upper edge 120 of the receptacle bracket 116.

The rearward portion of the receptacle support wall 118 is formed to protrude over the top edge 120 of the bracket 116. The receptacle 50 slides along the bracket edge 120 with that edge contacting the underside of the rail 124.

The well 122 of the receptacle 50 includes a thin divider plate 123 (refer to FIGS. 2 and 7) that divides the well into left and right halves. The left half of the well 122 is divided by a second divider plate 125. The dividers 123, 125 define within the left half of the receptacle well 122 a black-ink well 57 that receives the black ink fired by the microprocessor for detecting whether a black or color pen is carried in the carriage. The remaining portion of the left half of the well is filled with absorbent material 55 for receiving the liquid portion of color ink. The color ink is discharged by the color pen into the right half of the receptacle well 122. In this regard, the color ink well half includes a sloping surface 127 against which the color ink is ejected from the pen. Many of the solids in the color ink are captured on the surface 127. The liquid portion of the color ink that reaches the bottom of the surface 127 passes through the apex of a V-shaped groove in the divider wall 123, from where the liquid is drawn by the absorbent material 55.

A downwardly protruding leg 128 is formed in the receptacle support wall 118. The leg 128 includes a hooked end 130 that fits within an oblong opening 132 (FIG. 2) formed through the receptacle bracket 116. Accordingly, the hooked leg 128 of the support wall 118 limits the motion of the receptacle 50 to rearward and forward sliding movement along the bracket 116. A protuberance 134 is formed to protrude from the inner surface of the receptacle bracket 116 just above the oblong opening 132. The protuberance 134 serves as a detent mechanism that is adjacent to the rearward side of the hooked leg 128 of the receptacle 50 when the receptacle is closed to secure the spindle 62 within the notch 66.

The upper forward end of the receptacle support wall 118 includes a forwardly extending nose 138 that fits beneath a ledge 140 formed to project inwardly from the inner sidewall 86 (FIG. 2). The receptacle 50 is movable into the closed position as shown in FIG. 1, whereby the rail 124 is positioned to extend above the spindle 62 to prevent upward movement of the spindle 62 out of the notch, and wherein the portion 119 (FIG. 2) of the support wall 118 beneath the rail 124 extends across the notch 66 to prevent the spindle 62 from protruding beyond the inner surface of the sidewall 86.

When the receptacle 50 is moved rearwardly out of the closed position, the inner spindle 62 in the notch 66 is uncovered by both the rail 124 and support wall portion 119 thereby to provide sufficient clearance for removal of the inner spindle from the notch 66.

Referring to FIG. 3, the carrier 48 includes the spur gear 56 that is adjacent to and concentric with the outer spindle 64 that protrudes from the outer surface 130 of the spur gear. Approximately two thirds of the periphery of the spur gear 56 is formed with teeth 135. A stop 136 protrudes substantially radially outwardly from the periphery of the spur gear 56 between the set of teeth 135. As described more fully below, the stop 136 establishes the range of motion of the carrier 48.

A thin, flat base plate 138 extends from the inner surface 131 of the spur gear 56 toward the inner spindle 62 of the carrier 48. The longitudinal center line of the base plate 138 is concentric with the axis of rotation 70 of the carrier 48. The inner end of the base plate 138 terminates in two L-shaped end plates 140, 142 that extend above and beneath the base plate on opposing sides of the rotational axis 70 of the carrier 48. Two inwardly projecting, parallel legs 144, 146 of the end plates 140, 142 are joined by a web 145. The inner spindle 62 is formed to extend inwardly from that web 145 between and beyond the legs 144, 146 of the L-shaped end plates 140, 142.

Between the innermost end of the inner spindle 62 and the end plates 140, 142, the cam 72 is formed on the spindle 62. The eccentric 74 of the cam is arranged so that the greatest amount of radial protrusion of the cam is in the radial direction that is perpendicular to the flat base plate 138. Whenever the carrier 48 is rotated to place the black sled 58 in the service position, the cam eccentric 74 protrudes upwardly. Whenever the carrier is rotated to place the color sled 60 in the service position, the cam eccentric 74 protrudes downwardly. As described more fully below, the cam 72 moves the black-pen wiper 40 into and out of the wiping zone.

As noted earlier, each side of the carrier 48 carries a sled 58, 60 that is movable relative to the carrier for capping a pen. For the purpose of this portion of the description, the black sled 58 is said to be mounted to the top of the carrier 48 and the color sled is said to be mounted to the bottom of the carrier 48. It will be appreciated, however, that when the color sled is moved into the service position (FIG. 7), it will be above the black sled 58.

Looking first at the black sled 58 and related components for capping a black pen 26, and with particular reference to FIGS. 1, 3, 8 and 9, the black sled 58 rests upon the top surfaces 150T, 152T of two spaced-apart sidewalls 150, 152 that extend above and beneath the edges of the carrier base plate 138 between the spur gear 56 and the end plates 140, 142. More particularly, the black sled 58 includes a frame 154 that fits close to and between the opposing sidewalls 150, 152 of the carrier 48 and is supported on those sidewalls by four feet 156, one foot protruding from each corner of the frame. The curved underside of each foot 156 rests upon part of the top surface 150T, 152T of a sidewall.

Normally (that is, when the carriage 24 is not driven against the sled 58), the sled 58 is biased by a spring 184 into a standby position (FIG. 4) wherein each foot 156 rests upon a horizontal flat 160 (hereafter referred to as standby flats 160) formed in the carrier sidewall surfaces 150T, 152T.

The black sled 58 is secured to the carrier 48 in a manner such that the sled is able to slide along the sidewall surfaces 150T, 152T without moving away from those surfaces whenever the sled is moved or the carrier is rotated. More particularly, an outer clip 162 is formed in the sled 58 near an outer corner of the frame 154 on one side of the sled. An inner clip 164 (FIG. 8) is formed in the sled 58 near an inner corner of the frame 154 on the other side of the sled. Each clip 162, 164 extends over the associated sidewall surface 150T, 152T and downwardly adjacent to the sidewall 150, 152. The free end of the outer clip 162 includes an enlarged head 163 that is held by a clip bracket 166 that is mounted to the carrier sidewall 150 between the top surface 150T and bottom surface 150B of the sidewall.

The clip bracket 166 (FIG. 3) includes a side part 168 that is spaced from the sidewall 150. A portion of the side part 168 includes a notch 170 to permit the head 163 of the clip 162 to fit between the side part 168 and the sidewall 150. Preferably, the clip 162 is shaped so that once the head 163 of the clip 162 is passed through the notch 170 and beneath the side part 168 of the clip bracket 166, the resilience of the clip 162 will force the head outwardly beneath the side part 168, thereby prohibiting removal of the clip 162 from the clip bracket 166 unless the clip is manually bent to allow the clip head 163 to pass back through the notch 170. The clip head 163 has a rounded upper surface 169 for sliding along the underside of the clip bracket side part 168.

The inner clip 164 of the black sled 58 is configured substantially the same as the outer clip 162. Moreover, the clip bracket 170 (FIG. 7) for receiving the inner clip 164 is configured substantially the same as the clip bracket 166 that receives the inner clip 162. Accordingly, the rounded clip head 165 of inner clip 164 is secured beneath the clip bracket 170.

Figure 8:
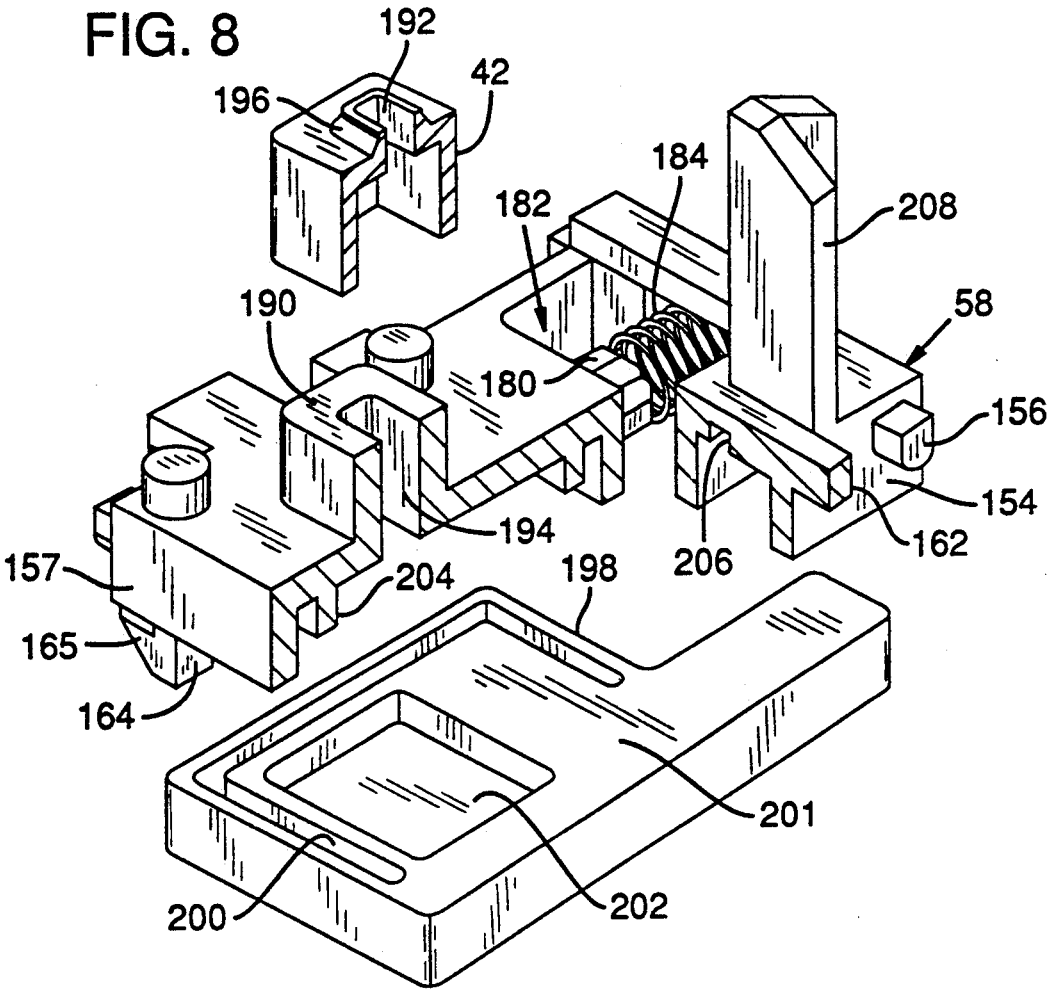
FIG. 8 is a perspective partial section view taken along line 8—8 of FIG. 3 and showing the sled that carries the cap for capping a black pen.
Figure 9:
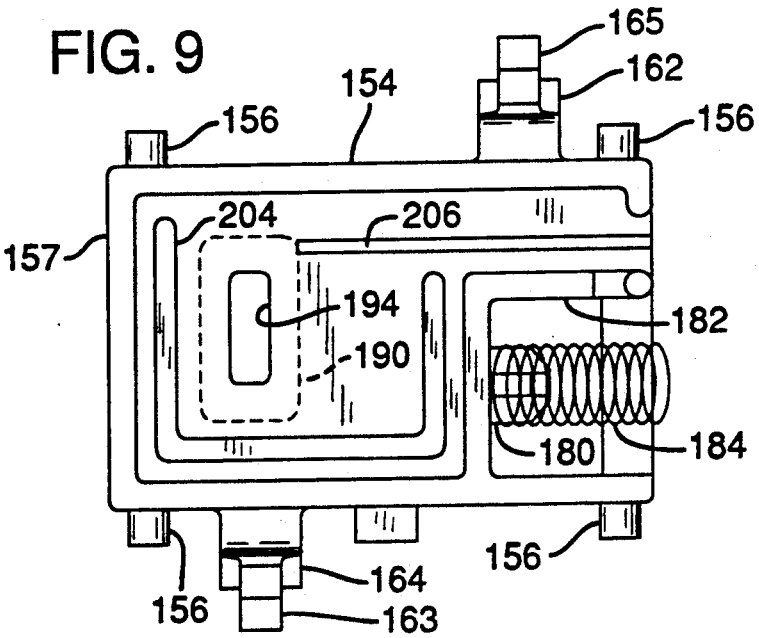
FIG. 9 is a bottom view of the sled of FIG. 8.

With reference to FIGS. 8 and 9, the outer end of the black sled 58 includes a post 180 that protrudes from the innermost side of a recess 182 formed in the outer end of the sled frame 154. One end of the compression spring 184 is anchored to the post 180. The other end of the spring 184 is anchored to another post 186 (FIG. 15) that protrudes from the inner surface 131 of the spur gear 56, the posts 180, 186 being substantially coaxial. The spring 184 normally urges the black sled 58 into the standby position with the sled feet 156 resting on the standby flats 160. When in the standby position, the inner end 157 of the black sled frame 154 is held against the end plates 140, 142 of the carrier.

The cap 42 that is carried by the black sled 58 is formed of resilient material, such as synthetic rubber. The black sled 58 includes an upwardly projecting hollow cap support 190 over which tightly fits the black cap 42. The top of the black cap 42 has an oblong hole 192 formed therein corresponding to the shape of a central opening 194 in the hollow cap support 190. A relatively thin ridge 196 (FIG. 8) of cap material extends upwardly from the periphery of the hole 192. The cap 42 is sized so that whenever the ridge 196 of the cap is pressed against the orifice plate 30 of a pen 26, the nozzles in the orifice plate will be substantially surrounded by the ridge 196, thereby placing the orifices in sealed fluid communication with the contiguous openings 192, 194 in the cap 42 and cap support 190.

The underside of the black sled 58 is formed to carry a flexible rubber basin 198 that fits into the sled frame 154 for the purpose of substantially closing the lower end of the opening 194 in the cap support 190. The basin 198 is shaped to conform to the shape of the sled underside and includes in its upper surface 201 a continuous groove 200 formed in three sides thereof. The basin 198 also includes in its upper surface 201 a recess 202 that is spaced from, but substantially surrounded on three sides by the groove 200.

When the basin 198 is pressed into the underside of the black sled 58, the groove 200 receives a correspondingly shaped rib 204 that projects from the underside of the sled 58. The portion of the basin surface 201 surrounding the recess 202 is pressed against the underside of the black sled to surround and substantially seal the lower end of the opening 194 of the cap support 190 in fluid communication with the recess 202.

The recess 202 and the opening 194 comprise, when the cap is sealed against the orifice plate, a substantially closed chamber into which the nozzles open. The chamber prevents drying of ink in the nozzles, which might occur if the nozzles were exposed to dry, ambient air. The enclosed nozzles are also protected from dust.

Preferably, a small channel 206 (FIG. 8) is formed in the underside of the black sled 58 to provide a small-diameter path for limited fluid communication between the basin recess 202 and ambient air. The presence of the path between the recess 202 (hence, opening 194) and ambient air ensures that any significant increase in pressure within the opening 194 (for example, an increase resulting from a sudden rise in ambient temperature) would be relieved by venting air out through the ambient path, thereby eliminating the possibility that air in the opening 194 would be forced into the nozzles of the pen.

When the pen is inactive, the carriage is controlled to move the pen into a parked position for capping the pen. As best shown in FIG. 5, whenever the carriage 24 is moved into the parked position, the outer side 25 of the carriage 24 contacts an arm 208 that protrudes upwardly from the outer end of the black sled 58. The carriage 24, therefore, pushes the sled 58 outwardly for a short distance (compressing the spring 184) so that the sled moves from the standby position (FIG. 4) to a capping position (FIG. 5).

As the sled 58 moves from the standby toward the capping position, the feet 156 are pushed along upwardly inclined surfaces or "ramps" 161 formed in the carrier sidewalls top surfaces 150T, 152T. Each ramp 161 is inclined approximately 30 and joins at its outermost end a flat horizontal portion of the sidewall surfaces, those portions hereafter referred to as capping flats 167.

It is noteworthy that the bottom of the side part 168 of the clip bracket 166 is shaped (FIG. 4) to conform to the shape of the standby flats 160, ramps 161 and capping flats 167 in the sidewall surface 150T. Accordingly, the head 163 of the clip 162 is able to follow the upward and downward motion of the sled between the flats 160, 167.

In traveling from the standby to the capping position, the cap 42 carried by the black sled 58 moves upwardly so that the cap ridge 196 presses against and seals around the orifice nozzles as described earlier. When the pen carriage 24 is moved out of the parked position to resume printing, the spring 184, no longer opposed by the side 25 of the carriage, expands to restore the sled 58 to the standby position. The cap 42, therefore, moves downwardly out of contact with the pen.

While the black sled 58 is in the service position, the exposed surface of the orifice plate 30 of the black pen 26 is wiped by the black-pen wiper 40 whenever the pen 26 moves into and out of the parked position (FIG. 4). As noted earlier, the wiper 40 is cammed upwardly into the wiping zone whenever the black sled 58 is rotated into the service position.

The flexible, synthetic-rubber, L-shaped wiper 40 is mounted to the top of the follower 73 (FIG. 3). In this regard, the follower 73 includes four sides 91 and has a generally T-shaped member 75 protruding upwardly from the top side to fit through an opening 77 formed in the base of the wiper 40. The member 75 secures the wiper 40 to the top of the follower 73. Two generally cylindrical, parallel guide rods 79, 89 protrude downwardly from the bottom of the follower 73. One rod 79 slides into a correspondingly shaped opening 81 formed in the chassis 22 beneath the inner notch 66 (FIG. 2). The other rod 89 slides within a curved recess 83 formed in the chassis 22. The opening 81 and recess 83, in conjunction with the guide rods 79, 89, guide the upward and downward movement of the follower 73, that movement occurring as the eccentric 74 of the cam 72 rotates with the carrier spindle 62.

The cam 72 fits within the opening defined by the four sides 91 of the follower 73 to abut a pair of internal stops 85 (only one shown in FIG. 3) formed in the follower, between which the innermost portion of the spindle 62 extends to seat within the inner notch 66. As best shown in FIG. 4, whenever the sled 58 is in the service position, the eccentric 74 of the cam 72 bears upon the underside 87 of the follower top, thereby keeping the tip of the wiper 40 within the wiping zone. Rotation of the carrier out of the black-sled service position causes the follower 73 to ride the rotating cam 72 downwardly to lower the black-pen wiper 40 out of the wiping zone (FIG. 7).

Turning now to a description of the color sled 60 and related components for capping the orifice plate 31 of a color pen 29, and with particular reference to FIGS. 3, 7, and 10–12, the color sled 60 rests upon the bottom surfaces 150B, 152B of the two spaced-apart sidewalls 150, 152 of the carrier 48. The color sled 60 includes a frame 3100 that fits close to and between the opposing sidewalls 150, 152. The frame 300 is supported on the surfaces of both sidewalls by four feet 304, one foot protruding from each corner of the frame 300. The curved underside of each foot 304 rests upon part of the bottom surface 150B, 152B of a sidewall 150, 152.

Normally (that is, when the carriage 24 is not driven against the sled 60), the sled 60 is biased by a spring 354 into a standby position (FIG. 7) wherein each foot 304 rests upon a horizontal standby flat 306 formed in the carrier sidewall surfaces 150B, 152B.

The color sled 60 is secured to the carrier 48 in a manner such that the sled 60 is able to slide along the sidewall surfaces 150B, 152B without moving away from those surfaces. More particularly, an outer clip 308 is formed in the sled 60 near an outer corner of the frame 300 on one side of the sled. An inner clip 310 (FIG. 3) is formed in the sled 60 near an inner corner of the frame 300 on the other side of the sled. Each clip 308, 310 extends over the associated sidewall surface 150B, 152B and adjacent to the sidewall 150, 152. The free end of the outer clip 308 has an enlarged head 318 that is held by a clip bracket 312 that is mounted to the carrier sidewall 152 between the top surface 152T and bottom surface 152B of the sidewall 152.

The clip bracket 312 includes a side part 314 that is spaced from the sidewall 152 of the carrier 48. Once the head 318 of the clip 308 is passed between the sidewall 152 and the side part 314 of the clip bracket 312, the resilience of the clip 308 will force the head 318 outwardly beneath the side part 314, thereby prohibiting removal of the clip 308 from the clip bracket 312. The clip head 318 has a rounded upper surface 320 for sliding along the underside of the clip bracket side part 314.

The inner clip 310 of the color sled 60 is configured substantially the same as the outer clip 308. Moreover, a clip bracket 322 (FIG. 4) for receiving the inner clip 310 is carried on the sidewall 150 and configured substantially the same as the clip bracket 312 that receives the inner clip 308.

Figure 10:
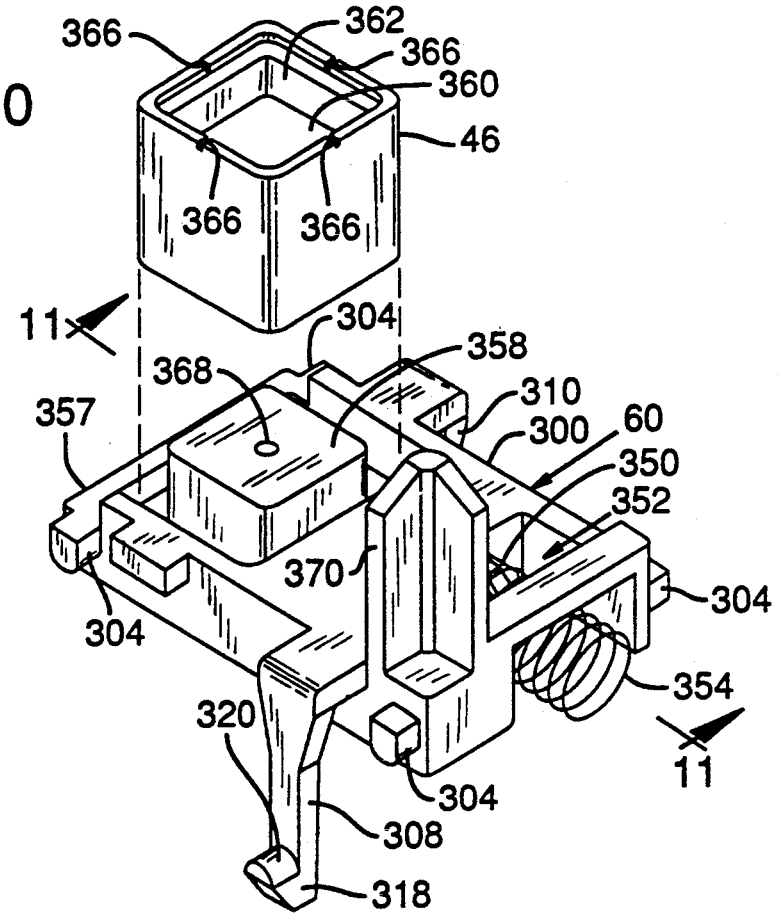
FIG. 10 is a perspective view showing the sled that carries the cap for capping a color pen.
Figure 11:
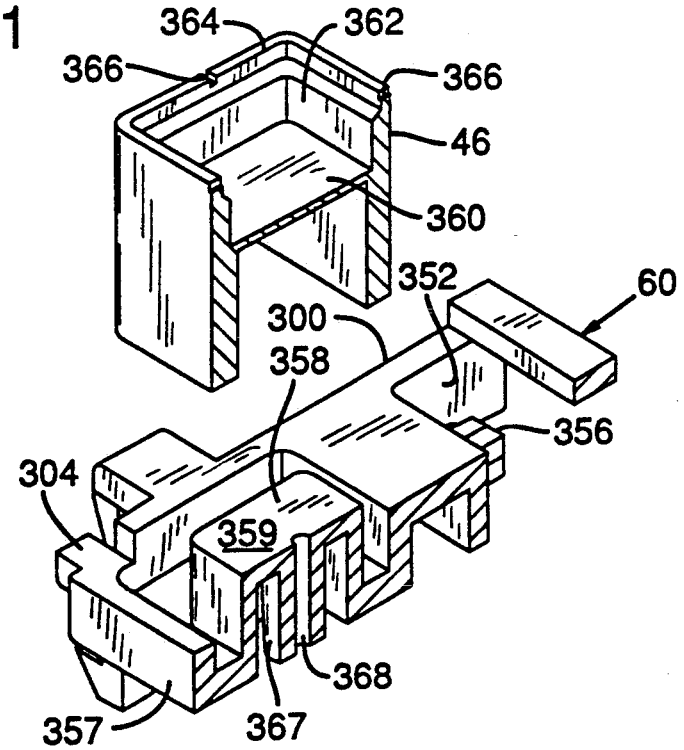
FIG. 11 is a perspective partial section view taken along line 11—11 of FIG. 10.
Figure 12:
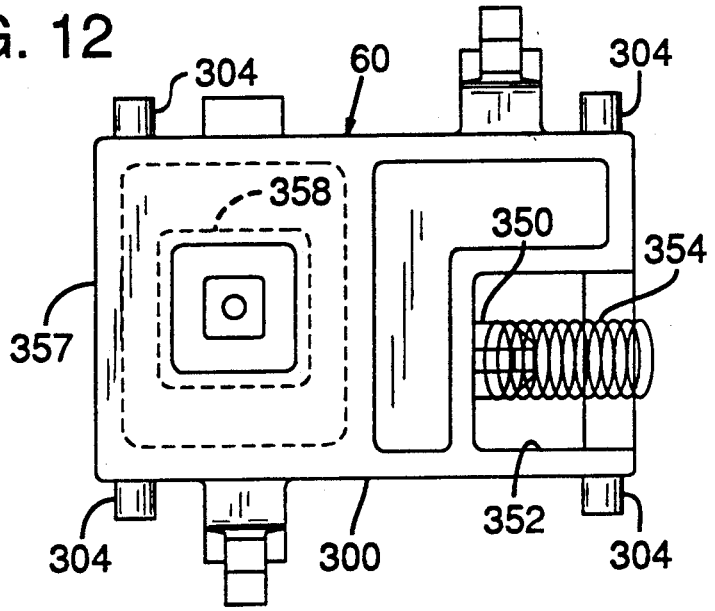
FIG. 12 is a bottom view of the sled of FIG. 10.

With reference to FIGS. 10–12, the outer end of the color sled 60 includes a post 350 that protrudes from the innermost side of a recess 352 formed in the outer end of the sled frame 300. One end of a compression spring 354 is anchored to the post 350, the other end of the spring 354 is anchored to another post 356 (FIG. 15) that protrudes from the inner surface 131 of the spur gear 56, the posts 350, 356 being substantially coaxial. The compressed spring 354 normally urges the color sled 60 to the standby position (FIG. 4) with the sled feet 304 resting on the standby flats 306. When in the standby position, the inner end 357 of the color sled frame 300 is held against the end plates 140, 142 of the carrier 48.

The cap 46 that is carried by the color sled 60 is formed of resilient material, such as synthetic rubber. The color sled 60 includes an upwardly projecting cap support 358 over which tightly fits the color cap 46. The color cap is a four-walled member having a thin, flexible internal membrane 360 above which is defined, in combination of the four cap walls, a sealing chamber 362. A relatively thin ridge 364 defines the uppermost edge of the cap walls. The ridge 364 has four spaced apart notches 366 for providing low-pressure venting of the chamber 322 when the cap 346 contacts the orifice plate 31 of a color pen 29.

The sealing chamber 362 is sized to enclose the entire orifice plate 31 and to include sufficient volume to absorb relatively high pressure increase that may occur within the sealed chamber 362 when, for example, the cap chamber 362 is pressed against the orifice plate 31. Moreover, the thin membrane 360, which is carried above the upper surface 359 of the cap support 358, readily deflects downwardly in order to absorb sudden increases in pressure in the sealing chamber 362, thereby preventing air in that chamber from being forced into the nozzles of the color pen orifice plate 31. A tube 367 with a small-diameter opening 368 provides fluid communication between ambient air and the space beneath the membrane 360, thereby to permit the membrane 360 to deflect without substantial resistance.

With reference to FIG. 7, whenever the color sled 60 is in the service position and the carriage 24 is moved into the parked position, the outer side 25 of the carriage 24 contacts an arm 370 that protrudes upwardly from the outer end of the color sled 60. The carriage, therefore, pushes the sled 60 outwardly a short distance (compressing the spring 354) so that the sled 60 moves from the standby position (solid lines, FIG. 7) to a capping position (cap 46 shown in dashed lines, FIG. 7). In moving from the standby toward the capping position, the feet 304 of the sled 60 are pushed along upwardly inclined ramps 372 formed in the carrier sidewall bottom surfaces 150B, 152B. Each ramp 372 is inclined approximately 30° and joins at it outermost end a flat horizontal portion of the sidewall surface, those portions hereafter referred to as a capping flats 374.

It is noteworthy that the bottom of the side part 314 of the clip bracket 312 is shaped (FIG. 7) to conform to the shape of the standby flats 306, ramps 372 and capping flats 374 in the sidewall surface 152B. Accordingly, the head 318 of the clip 308 is able to follow the upward and downward motion of the sled between the flats 306, 374.

When the pen carriage 24 is moved out of the parked position, the spring 354 expands to restore the sled 60 to the standby position.

While the color sled 60 is in the service position, the exposed surface of the orifice plate 31 of the color pen 29 is wiped by the color wiper whenever the pen moves into and out of the parked position (FIG. 7). The flexible wiper 44 includes a bottom opening 380 (FIG. 3) that is configured to allow the wiper 44 to tightly fit over a generally T-shaped member 382 that is formed between the legs 144, 146 of the end plates 140, 142 to extend from the bottom of those legs. The T-shaped member 382, therefore, extends in a direction relative to the spindle 62, opposite the direction that the cam eccentric 74 extends from the spindle 62.

Preferably, the color wiper 44 is divided to form two wiping tips 47, 49, thereby effectively doubling the wiping action of that wiper 44 for a single pass of the orifice plate 31. It is noteworthy that both the black-pen wiper 40 and color-pen 44 may be configured to include two discrete tips. A two-tip wiper may be more effective for wiping away paper dust and pooled residual ink from an orifice plate. For example, referring to the color wiper 44 (FIG. 7), the leading tip 47 (that is, the tip first encountering the orifice plate 31 when the plate moves toward the parked position) will wipe away most particles. Pooled ink, especially partly dried ink, however, tends to spread very thin, causing the blade tip 47 to plane over the thin layer. The trailing tip 49, being, as it is, in close proximity with the first blade 47, immediately contacts the spread layer of ink before that ink can reform into a pool. The combination of a leading tip 47 with adjacent trailing tip 49, therefore, effectively removes particles and residual ink from the orifice plate.

Figure 13:
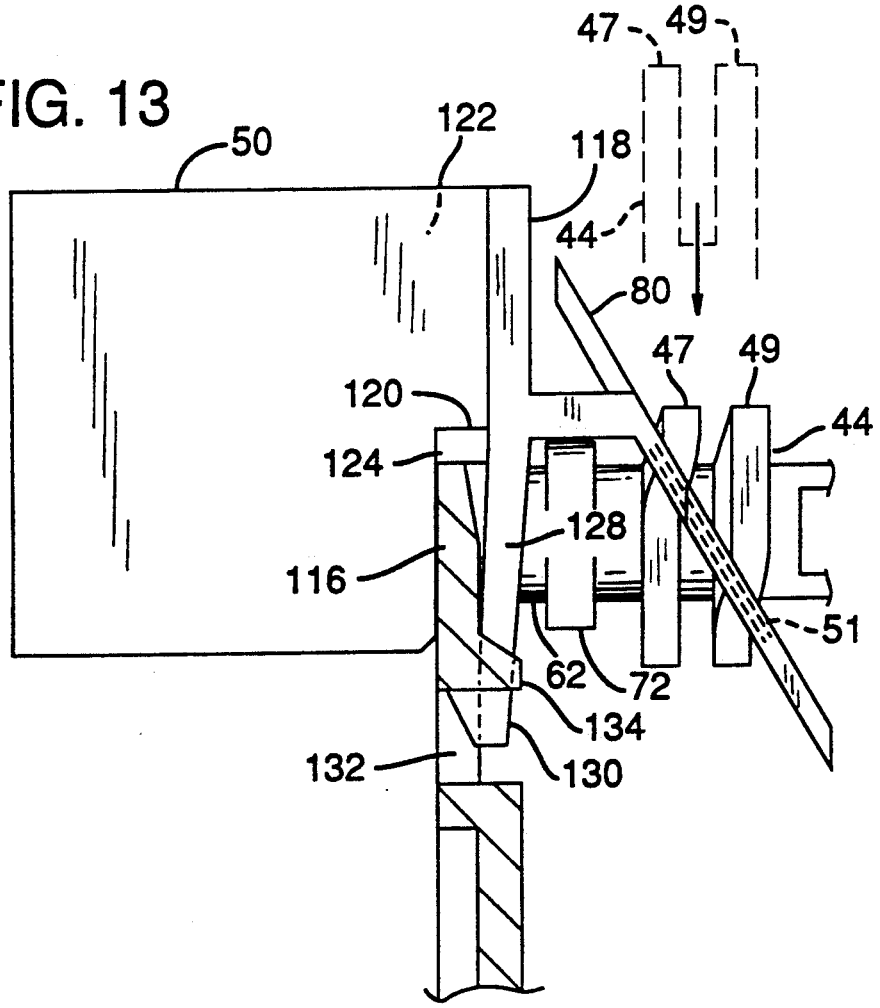
FIG. 13 is an enlarged detail view depicting a cleaning member for scraping the tips of the color wiper as the color wiper is moved into and out of a zone for wiping a pen.

Each time that the carrier 48 is rotated to move the color wiper 44 from the position shown in FIG. 4 into the wiping zone (FIG. 5) and back, the two tips 47, 49 of the wiper scrape against the cleaner bracket 80 that protrudes in cantilever fashion outwardly from the support wall 118 of the receptacle 50. With reference to FIGS. 2 and 13, the cleaner bracket 80 is configured with a concave-curved, tapered blade 51 for contacting the passing tips 47, 49 as the wiper 44 is rotated past the bracket 80 as shown in FIG. 13. The cantilever-type mounting of the bracket 80 allows the bracket to bend slightly when contacted by the wiper tips 47, 49 as the tips move into or out of the wiping zone. The slight bending of the bracket 80 minimizes the torque required for the wiper tips 47, 49 to pass the bracket 80. In other words, a stiffer bracket would require more torque be applied by the motor in turning the wipers. The curve in the blade, which contacts the wipers as they move in an arc, minimizes the maximum deflection of the tips against the blade, thereby minimizing the wiping torque required while still contacting the tips for scraping.

Figure 14:
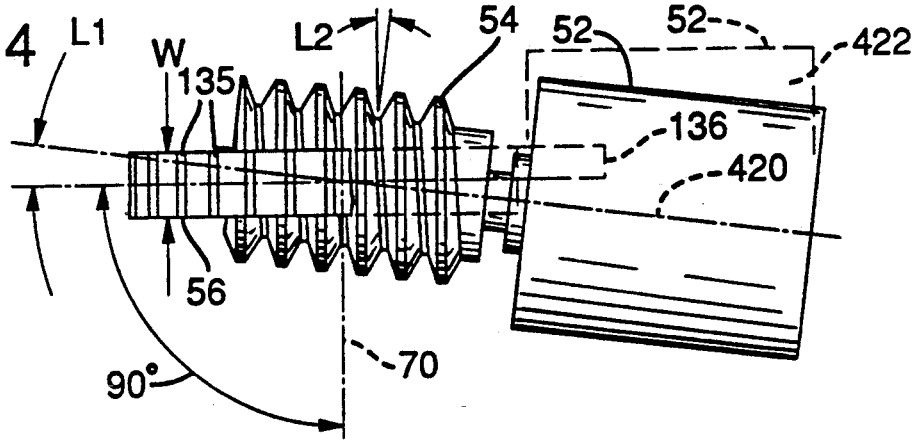
FIG. 14 is a diagram showing the positional relationship between a spur gear to which the sled carrier is attached and the worm that is driven by a motor for driving the spur gear.
Figure 15:
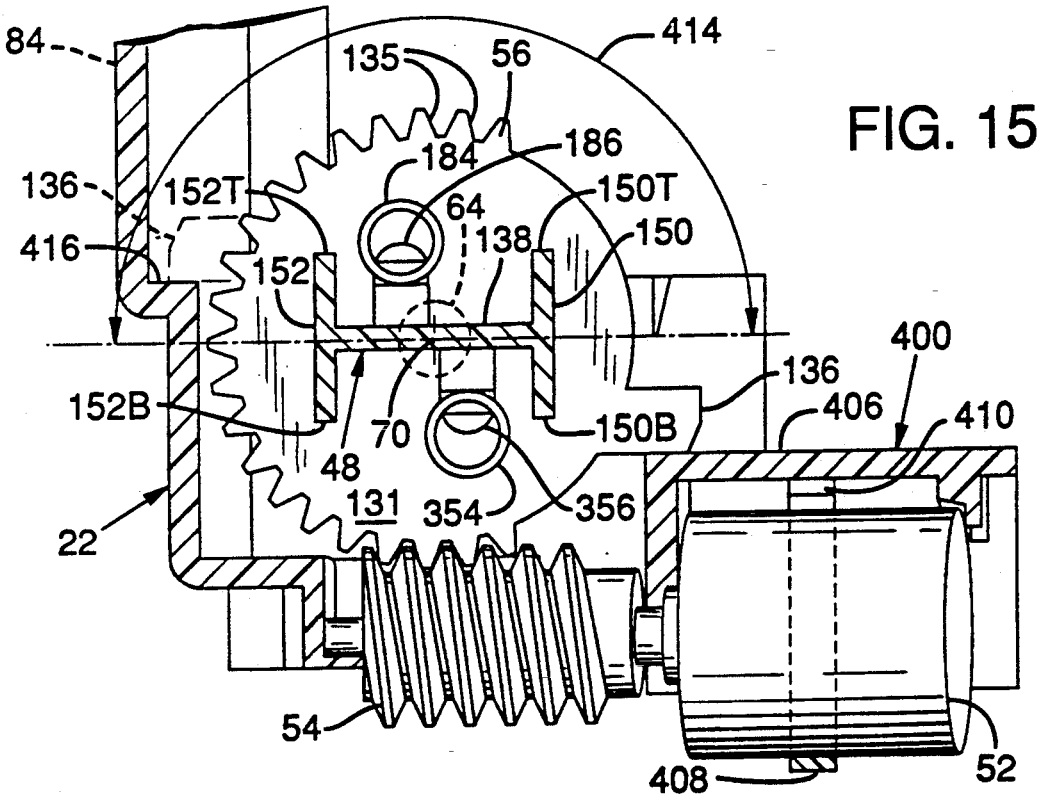
FIG. 15 is a section view taken along line 15—15 of FIG. 1 showing the spur gear position stops.

Turning now to the particulars of the gear-driven carrier 48, and with reference to FIGS. 1, 14 and 15, the DC motor 52 is clamped into a downward-opening, generally U-shaped housing 400 formed in the chassis 22 adjacent to the spur gear 56. Preferably, the motor 52 fits tightly between the opposing sidewalls 402, 404 of the housing 400, and is held against the underside of the housing top 406 by a U-shaped clamp 408. The clamp 408 has one end 410 hooked to the housing 400 and the opposing end 412 hooked to a bracket 413 formed in the chassis 22 next to the housing 400.

The drive shaft of the motor 52 carries the above-mentioned worm 54, which meshes with the teeth 135 of the spur gear 56. The worm 54 is rotatable by the motor in two directions. The stop 136 on the spur gear 56 limits the motion of the spur gear (and carrier 48) to back-and-forth rotation defined by the 180° arc indicated by arrow 414 in FIG. 15. In this regard, whenever the carrier 48 is driven to position the black sled 58 in the service position, the stop 136 on the spur gear 56 will abut the motor housing 400 as shown in solid lines in FIG. 15. Whenever the motor is driven to place the color sled 60 into the service position, the spur gear rotates through arc 414 until the stop 136 encounters a ledge 416 formed in the printer chassis 22.

A positional relationship of the drive motor 52 and worm 54 relative to the spur gear 56 is established for minimizing the outward protrusion of the motor housing 400, and for locking the spur gear 56 in place with the stop 136 abutting either the ledge 416 or housing top 406. Specifically, the motor 52 is mounted to the housing 400 so that the rotational axis 420 of the worm 54 (as viewed from above, FIG. 14) is in a plane offset from a perpendicular intersection with the plane through which passes the rotational axis 70 of the spur gear 56. This offset angle L1 matches the lead angle L2 of the threads of the worm 54. It can be appreciated upon review of FIG. 14 that the orientation of the motor 52, reduces by an amount indicated in region 422, the outer (i.e., upward, in FIG. 14) protrusion of the motor 52 that would otherwise occur if the motor were oriented (dashed lines) so that its axis 420 perpendicularly intersected the axis 70.

Establishing the offset angle L1 to match the worm lead angle L2 ensures that substantially the entire width (shown as W in FIG. 14) of each tooth 135 that contacts the worm thread lies substantially flat across the contacting portion of the worm thread. Unintentional rotation of the spur gear 56 caused, for example, by vibration will not tend to rotate the meshed worm 54 because any force applied by the spur gear teeth 135 to the worm thread is substantially perpendicular to the rotational direction of the worm thread and will not rotate the worm as long as the coefficient of friction between the gear teeth and the worm threads is greater than the tangent of the lead angle L2. This force distribution avoids any unwanted rotation of the worm thread, thereby locking the spur gear in place until the motor 52 is activated.

Having described and illustrated the principles of the invention with reference to a preferred embodiment, it should be apparent that the invention can be further modified in arrangement and detail without departing from such principles. It should be understood, therefore, that the embodiment described and illustrated should be considered illustrative only, not as limiting the scope of the invention. The invention is to include all such embodiments as may come within the scope and spirit of the following claims and equivalents thereto.

We claim:

1. A method for servicing a pen that is installed in a printer for movement between a printing position and a service position, comprising the steps of:

installing into a printer a selected one of first and second pens for movement between a printing position and a service position within the printer;

providing a rotatable carrier upon which a first capping member and second capping member are carried;

detecting which of the first and second pens is installed in the printer;

rotating the carrier for placing the first capping member in position for capping the first pen when the first pen is detected as installed in the printer; and rotating the carrier for placing the second capping member in position for capping the second pen when the second pen is detected as installed in the printer.

2. The method of claim 1 including the steps of:

placing a first wiper into position for contact with the first pen whenever the first pen is moved from the printing position to the service position; and placing a second wiper into position for contact with the second pen whenever the second pen is moved from the printing position to the service position.

3. An apparatus for positioning a selected one of at least two service components in a linear path traversed by a pen that is installed in a printer, the apparatus comprising:

a base of a printer;

a carrier mechanism mounted to the base for rotation about a first axis relative to the base, the carrier mechanism being located adjacent to the path with the first axis being generally parallel to the linear path;

a first service component mounted to the carrier mechanism;

a second service component mounted to the carrier mechanism; and drive means for rotating the carrier mechanism between a first orientation wherein the first service component is located at a first position in the path of the pen for contacting the pen and a second orientation wherein the second service component is located at the first position in the path of the pen for contacting the pen, wherein the location of the first axis relative to the base is unchanged as the first and second service components are moved into the first position.

4. The apparatus of claim 3 wherein the first service component is a wiper member for wiping part of a pen as the pen traverses the path.

5. The apparatus of claim 4 further comprising a cleaner member for scraping the wiper member as the drive means rotates the carrier mechanism about the first axis.

6. The apparatus of claim 4 wherein the wiper member includes two tips located adjacent one another for wiping part of a pen as the pen traverses the path.

7. The apparatus of claim 4 wherein the second service component is a wiper member for wiping part of a pen as the pen traverses the path.

8. The apparatus of claim 3 wherein the first service component is a member for capping a pen that traverses the path.

9. The apparatus of claim 8 wherein the second service component is a member for capping a pen that traverses the path.

10. The apparatus of claim 3 wherein the drive means includes a worm rotatably drivable about a second axis for engaging and rotating the carrier mechanism about the first axis.

11. The apparatus of claim 10 wherein the first and second axes are oriented at an oblique angle relative to one another.

12. The apparatus of claim 3 further comprising detection means for detecting information concerning the color of ink held in the pen traversing the path and for activating the drive means in response to the detected information.

13. An apparatus for moving a selected one set of at least two sets of service components into a first position along a path traversed by a pen, the apparatus comprising:

a carrier mechanism;

a first service component set mounted to the carrier mechanism, the first service component set including a wiper mechanism for wiping part of a pen and a capping mechanism for capping part of the pen;

a second service component set mounted to the carrier mechanism; and drive means for moving the carrier mechanism between a first orientation wherein the first service component set is located at a first position for contacting the pen and a second orientation wherein the second service component set is located at the first position for contacting the pen.

14. The apparatus of claim 13 wherein the second service component set includes a wiper mechanism for wiping part of a pen and a capping mechanism for capping part of the pen.

15. The apparatus of claim 14 further comprising a curved blade mounted near the carrier mechanism for cleaning the wiper mechanism of the second component set as the drive means moves the carrier mechanism between the first orientation and the second orientation.

16. The apparatus of claim 14 wherein the capping mechanism of the first service component set is carried on a sled that is mounted to slide on the carrier mechanism and wherein the capping mechanism of the second service component set is carried on a sled that is mounted to slide on the carrier mechanism.

17. The apparatus of claim 13 further including a cam attached to the carrier mechanism for rotation therewith, the cam located for engaging the wiper mechanism of the first service component set for moving that wiper mechanism into the path traversed by the pen.

* * * * *